US005378143A

United States Patent [19]

Ansquer

[11] Patent Number: 5,378,143

[45] **Date of Patent: * Jan. 3, 1995**

[54] SAFETY LIGHTER

[75] Inventor: Henri Ansquer, Quimper, France

[73] Assignee: Sibjet, Paris, France

[ * ] Notice: The portion of the term of this patent subsequent to Jul. 6, 2010 has been disclaimed.

[21] Appl. No.: 965,152

[22] Filed: Oct. 20, 1992

Related U.S. Application Data

[63] Continuation of Ser. No. 439,260, Nov. 17, 1989.

[30] Foreign Application Priority Data

Jul. 1, 1988 [FR] France ..... 88 08912
Jul. 11, 1988 [FR] France ..... 88 09387

[51] Int. Cl.[6] ..... F23D 11/36
[52] U.S. Cl. ..... 431/153; 431/277
[58] Field of Search ..... 431/153, 277, 255; 222/153, 402, 11

[56] References Cited

U.S. PATENT DOCUMENTS

| | | | |
|---|---|---|---|
| 1,895,032 | 1/1933 | Fisher . | |
| 2,520,328 | 8/1950 | Nissen | 431/153 X |
| 2,727,376 | 12/1955 | Felt . | |
| 3,169,672 | 2/1965 | Soffer et al. . | |
| 3,859,035 | 1/1975 | Schlamp . | |
| 3,924,782 | 12/1975 | Starrett . | |
| 3,938,943 | 2/1976 | Malamoud . | |
| 3,961,876 | 6/1976 | Chernock . | |
| 4,024,988 | 5/1977 | Starrett . | |
| 4,028,043 | 6/1977 | Neyret . | |
| 4,049,370 | 9/1977 | Neyret . | |
| 4,157,891 | 6/1979 | Moriya . | |
| 4,243,377 | 1/1981 | Schmid . | |
| 4,295,819 | 10/1981 | Sugiyama . | |
| 4,332,549 | 6/1982 | Fuller . | |
| 4,403,945 | 9/1983 | Letgib . | |
| 4,432,542 | 2/1984 | Poynter . | |
| 4,471,404 | 9/1984 | Nitta . | |
| 4,496,309 | 1/1985 | Schachter . | |
| 4,516,933 | 5/1985 | Buzzi . | |
| 4,560,345 | 12/1985 | Schachter . | |
| 4,569,654 | 2/1986 | Borghesi . | |
| 4,595,352 | 6/1986 | Endelson . | |
| 4,717,335 | 1/1988 | Loveless . | |
| 4,758,152 | 7/1988 | Kordecki . | |
| 4,773,849 | 9/1988 | Schachter . | |
| 4,784,601 | 11/1988 | Nitta . | |
| 4,784,602 | 11/1988 | Nitta . | |
| 4,786,248 | 11/1988 | Nitta | 431/153 X |
| 4,799,877 | 1/1989 | Bisbee . | |
| 4,822,276 | 4/1989 | Bisbee . | |
| 4,830,603 | 5/1989 | Cirami | 431/153 |
| 4,832,596 | 5/1989 | Morris, Sr. | 431/153 |
| 4,850,854 | 7/1989 | Buck . | |
| 4,859,172 | 8/1989 | Nitta . | |
| 4,869,662 | 9/1989 | LeCourt et al. . | |
| 4,869,663 | 9/1989 | Fremund . | |
| 4,878,836 | 11/1989 | Nitta . | |
| 4,884,965 | 12/1989 | Nitta . | |
| 4,889,482 | 12/1989 | Schachter . | |
| 4,904,180 | 2/1990 | Nitta . | |
| 4,921,420 | 5/1990 | Johnston | 431/153 |
| 4,992,042 | 2/1991 | Knuepfer . | |
| 5,002,482 | 3/1991 | Fairbanks et al. . | |

FOREIGN PATENT DOCUMENTS

| | | | |
|---|---|---|---|
| 372173 | 9/1983 | Austria . | |
| 1145658 | 5/1983 | Canada . | |
| 285748 | 10/1988 | European Pat. Off. . | |
| 296281 | 12/1988 | European Pat. Off. . | |
| 312627 | 4/1989 | European Pat. Off. . | |
| 2220047 | 9/1974 | France . | |
| 2280029 | 2/1976 | France . | |
| 2465161 | 3/1981 | France . | |
| 2468838 | 5/1981 | France . | |
| 3040596 | 5/1981 | Germany . | |
| 8802582 | 4/1988 | Germany . | |
| 52-117197 | 9/1977 | Japan | 431/153 |
| 56-85638 | 7/1981 | Japan . | |
| 56-32749 | 8/1987 | Japan | 431/153 |
| 636943 | 6/1983 | Switzerland . | |
| 2062200 | 5/1981 | United Kingdom . | |
| 2072820 | 7/1981 | United Kingdom . | |
| 8100752 | 3/1981 | WIPO . | |

OTHER PUBLICATIONS

Certificate of Accuracy for French Patent Application No. 2 465 161 et al.

Certificate of Accuracy for Austrian Patent No. B 372 173 et al.

Certificate of Accuracy for French Patent Apllication No. 2 468 838.
Certificate of Accuracy for French Patent No. 79 26889.
Certificate of Accuracy for Canadian Patent No. A 1,145-658.

*Primary Examiner*—Carl D. Price
*Attorney, Agent, or Firm*—Morgan & Finnegan

[57] ABSTRACT

A safety catch (11) is moveable in a slot (25) of the lighter body (1) and a pushbutton (7) thereon cannot be pressed down unless the catch (11) is in a central position, with a spring returning the catch to the safe position automatically.

12 Claims, 3 Drawing Sheets

SAFETY LIGHTER

This is a continuation of co-pending application Ser. No. 07/439,260 filed 17 Nov. 1989 parent application Ser. No. 07/439,260 is a continuation of the international application corresponding to PCT/FR 89/00339. PCT/FR 89/00339 corresponds to French national applications FR 88 08912 filed Jul. 1, 1988, and FR 88 09387 filed Jul. 11, 1988.

BACKGROUND OF THE INVENTION

The present invention relates to a safety lighter providing safety operation, being capable of lighting only after a cocking operation.

Currently manufactured gas lighters generally comprise a supply of liquified gas, an expander, a burner, and a flint-and-striking-wheel lighting assembly. The burner is moveable in translation, and depending on its position, expanded gas is allowed to flow or is prevented from flowing. It is known that the motion of the burner can be controlled by means of a tilting pushbutton on which the user's thumb bears, with burner motion taking place after causing the striking wheel to rotate (which wheel is in contact with the flint in conventional lighting). The tilting motion of the pushbutton raises the burner head, thereby allowing expanded gas to rise into the sparks. When piezoelectric lighting is used, then the sparks are generated by applying pressure to a pushbutton which is a sliding member and which also allows gas to flow.

In general, manufacturers have sought to make lighting a lighter as simple as possible. However, such lighters present dangers if used by children.

The object of the present invention is to mitigate this drawback by making a lighter more difficult to light so that it can be lighted only after a determined and deliberate operation, and in particular so that a child cannot cause it to light. In general, the invention seeks to increase operating safety for lighters, and also relates to the pushbutton of the lighter.

In order to return the burner automatically towards its closed position, a spring is generally provided beneath the pushbutton with the spring returning the burner to its rest position in which the flow of gas is cut off, with the gas flow channel being closed by a seal.

The spring must be powerful enough to act via the pushbutton and the burner to cause the seal to be pressed adequately against its seat. However, for safety reasons, it turns out that the spring needs to be more powerful than is required for ensuring sealing so as to ensure that there is no danger of accidental lighting due, for example, to the pushbutton bearing against an obstacle inside a pocket.

SUMMARY OF THE INVENTION

It is therefore desired for the lighting of a lighter to take place only as a result of a deliberate action on the part of the user requiring a non-negligible amount of force to be applied to the pushbutton. Unfortunately, if the spring is very powerful, then its action is conveyed to the seal in the burner, thereby crushing it and damaging it. This gives rise to leaking which is dangerous and incompatible with normal operation.

A second object of the present invention is to mitigate this drawback and to enable a powerful pushbutton spring to be used without damaging the burner seal.

According to the present invention, the safety lighter including a pushbutton is characterized in that it comprises, beneath the pushbutton, removeable locking means for preventing motion of the pushbutton, said locking means constituting a safety catch or tab, and being capable of being inserted in an opening provided in the rear portion of the pushbutton.

In order to simplify identifying its position, the safety catch is preferably displaceable in a plane perpendicular to the longitudinal midplane of the lighter.

However, after lighting up, the user must return the safety catch to its locking position. Very frequently, this operation will be neglected or forgotten, thereby making the device ineffective since safety is achieved only if it is maintained permanently.

Thus, according to another characteristic of the present invention, the catch is fixed to means for automatically returning it to the locking position. These means may be constituted, for example, by a spring which is tensed when the user moves the catch to the operating position. However, in order to allow the user to light the lighter using one hand only, the front end of the spring may be hooked to a hook, with a cam fixed to the pushbutton or a cam fixed to the catch enabling the spring to be disengaged from the hook, and with the spring being kept tense so long as pressure is applied to the pushbutton.

According to another characteristic of the invention, the pushbutton of a liquified gas lighter is characterized in that its front portion includes a flexible zone and a rigid zone, with a stroke-limiting abutment projecting from the rigid zone towards the body of the lighter.

Contact between the front portion of the pushbutton and the burner head always takes place via the flexible zone which acts somewhat as a shock absorber when transmitting the force released by the pushbutton spring. Thus, the pressure on the seal is made independent of the force of the pushbutton spring, with the rigid zone or portion of the front portion of the pushbutton being stopped by the abutment. It is thus possible to mount a powerful spring on the lighter for satisfying safety requirements but without damaging the seal. For example, the spring may exert a force of 15 newtons to 20 newtons while the force on the burner seal is kept down to 2 newtons or 3 newtons.

BRIEF DESCRIPTION OF THE DRAWING

Other characteristics and advantages of the invention appear from reading the following description of particular embodiments given purely by way of non-limiting example and with reference to the accompanying drawings, in which.

DESCRIPTION OF THE PREFERRED EMBODIMENT

Figure 1:
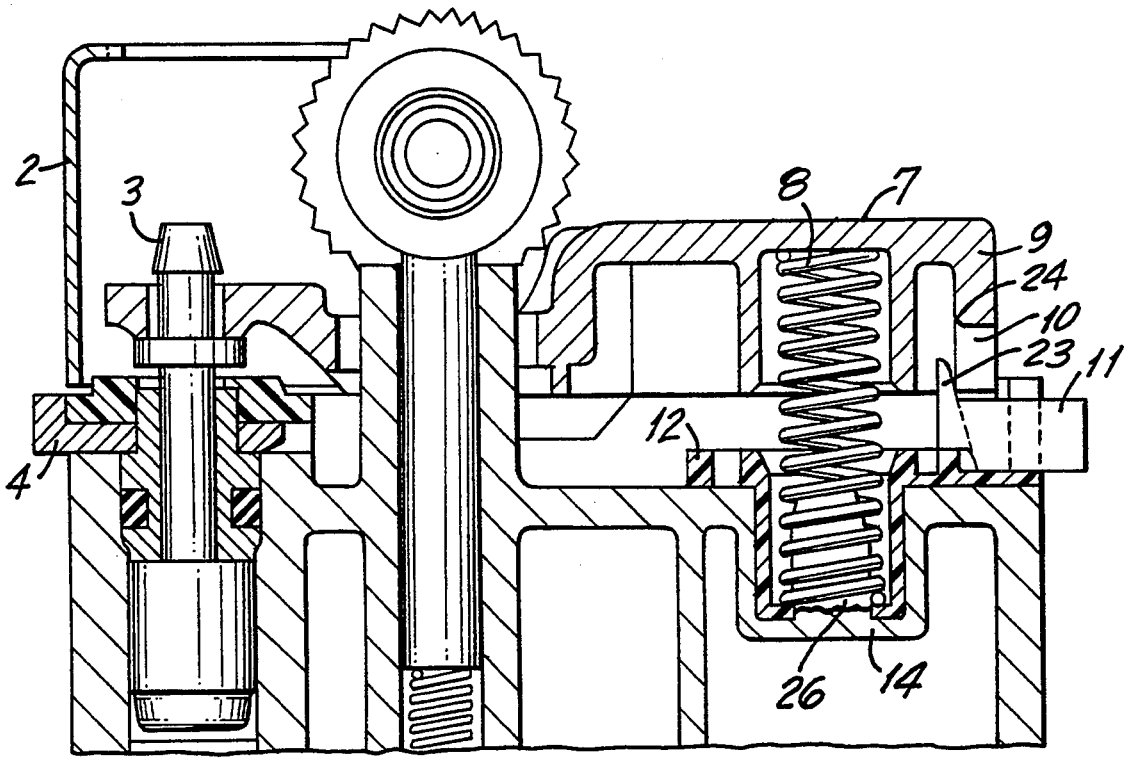
FIG. 1 is a vertical section through the top portion of a safety lighter in accordance with the invention.

FIG. 1 shows conventional components used in lighter manufacture, and in particular the upper body surface on the top end of a main lighter body 1, a burner 3, and a knob 4 for adjusting the height of the flame, partially included inside a protective cover 2. The pushbutton or pushbutton member 7 is hinged to the body and has a pushbutton front end 27 which co-operates with the burner head 3. The pushbutton has a pushbutton back end which co-operates with a compression spring 8 disposed between the body 1 and the inside surface of the back end of the pushbutton.

Figure 2A:
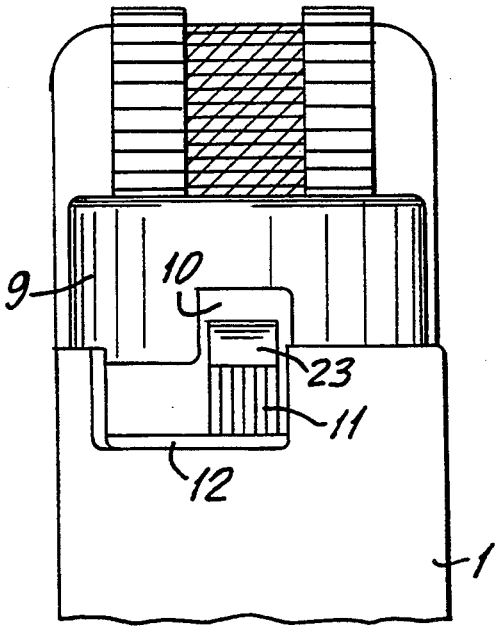
FIGS. 2 and 2*a* are respectively a plan view and a rear view of a lighter in the utilization position.

In accordance with the invention, the depending backwall or rear sidewall 9 of the pushbutton includes an opening or notch 10. A locking means comprising a catch or lug 11 penetrates into the opening (in FIGS. 1, 2, and 2*a* which show the lighter in its operating position), said catch 11 being fixed to a ring 12 extending downwards in the form of a hub 13 rotatably received in a cavity 14 of the lighter body, which cavity also serves to receive one of the ends of the spring 8. Thus, as can be seen more clearly in FIGS. 2*a* and 3*a*, the catch 11 is free to rotate through an angle of about 60° in a side slot 25 through the sidewall of the lighter body, and preventing operation thereof except when in the unlocked non-interfering position corresponding to the notch 10. The pushbutton 7 is free to move only when the catch is in its unlocked non-interfering position shown in FIGS. 1, 2, and 2*a*, thereby allowing gas to be released.

Figure 2:
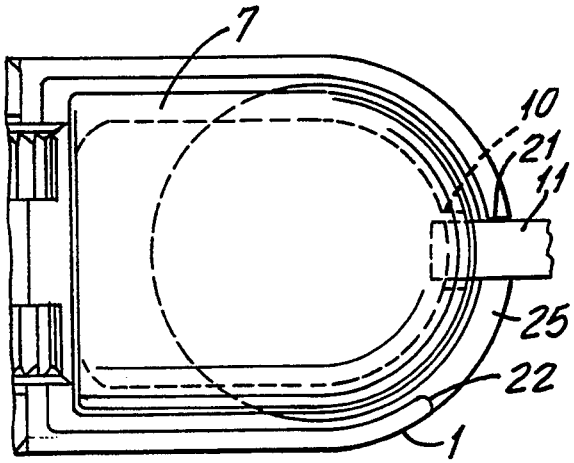
Figure 3A:
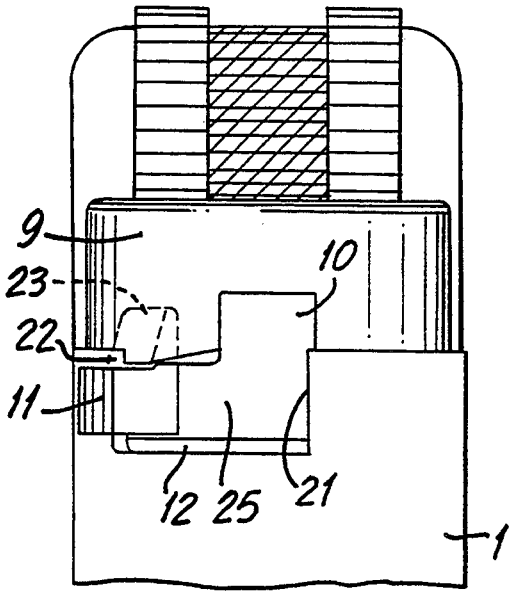
FIGS. 3 and 3*a* are corresponding views of the same lighter in the safety position.
Figure 3:
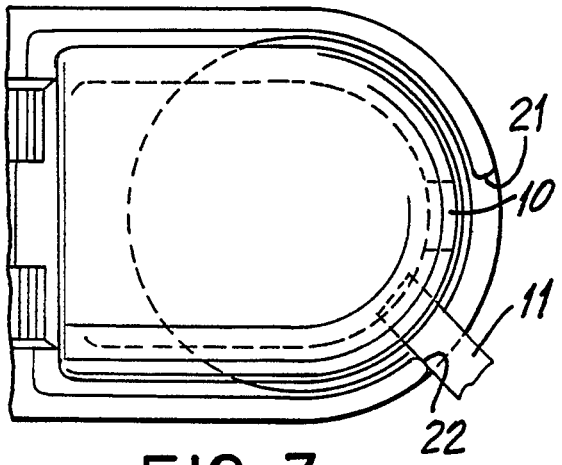

FIGS. 2, 2*a*, 3, and 3*a* show a portion of a first embodiment of the lighter seen from above and from behind. FIG. 2 shows that the catch 11 is free to move between two abutment-forming portions of the body 1, bearing respective references 21 and 22 and limiting the stroke of the catch 11. The catch 11 has fluting 35 enabling it to be moved into the desired position.

However, as mentioned above, it is desirable for the lighter to return automatically to the locked interfering or safe position after Sighting up. In order to achieve this aim, it is possible to use means as shown in FIGS. 4 and 5, respectively in the unlocked non-interfering or operating position and in the unlocked interfering or safe position, i.e. the position in which gas is prevented from flowing by virtue of the pushbutton 7 being locked.

In the example shown, the means for automatically returning the catch to the safe position are constituted by a locked spring comprising a spiral spring 18 having a central ring 15. The spring 18 is prevented from rotating anticlockwise by a stud 16 or by any other means. In this embodiment, the lug or catch 11 is fixed to the spring 18 and is guided, as before, through a slot or cut-out 25 between the body 1 and the pushbutton 7. A slight ramp may be provided on the pushbutton in order to facilitate engaging the catch 11 beneath the pushbutton when the catch returns to its safe or locking position, thereby assisting the action of the compression or pushbutton spring 8 and the spiral spring 18.

Figure 4:
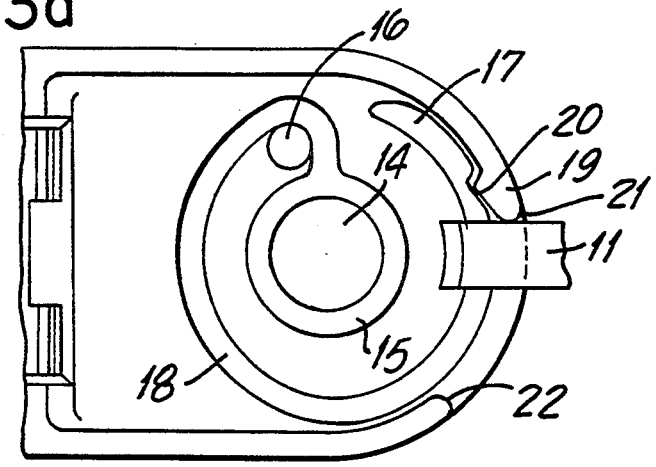
FIG. 4 is a plan view of the rear portion of the lighter, with the pushbutton removed, and showing the latch in the utilization position.
Figure 5:
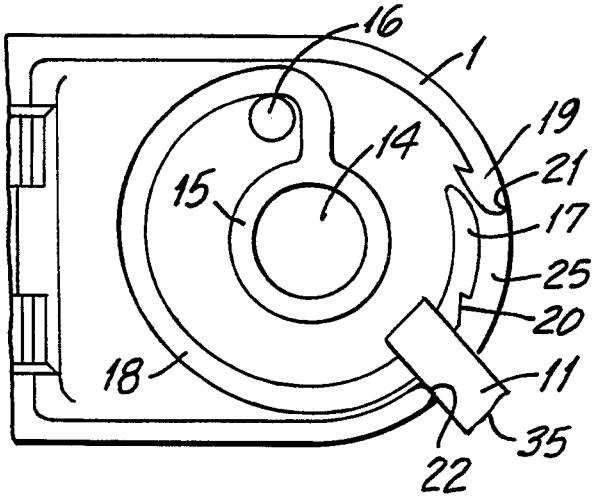
FIG. 5 is similar to FIG. 4, showing the latch in the safety position.

As can be seen in FIGS. 4 and 5, the front portion 17 of the spiral spring 18 has a notch 20 constituting a retainer, and in the vicinity of the edge 21 of the body there is a hook 19. When the lug 11 is moved to its operating position (FIG. 4) by application of an external locking force (e.g., applied by the user's finger) to the catch 11, the notch 20 latches behind the hook 19. The lighter is free to operate since its lug 11 is in an appropriate position, i.e. level with the notch 10.

When the user presses down the pushbutton 7, the surface 24 of the pushbutton (FIG. 1) bears against s tooth or cam 23 fixed to the lug 11, thereby urging it forwards, i.e. into the body of the lighter. This movement disengages the notch 20 from the hook 19. However, the cam 23 and the lug 11 remain held in place by the corresponding side of the notch 10. It is only after the pushbutton 7 has returned to its rest position under the action of the spring 8 that the lug 11 can escape into the slot 25, rotating under drive from the spring 18. The position taken up by the various components is then as shown in FIG. 5. Under the action of the spring 18, the lug 11 comes into abutment against the edge 22 of the slot 25, and before the lighter can be used again, the catch or lug 11 must be returned into alignment with the notch 10.

Figure 6:
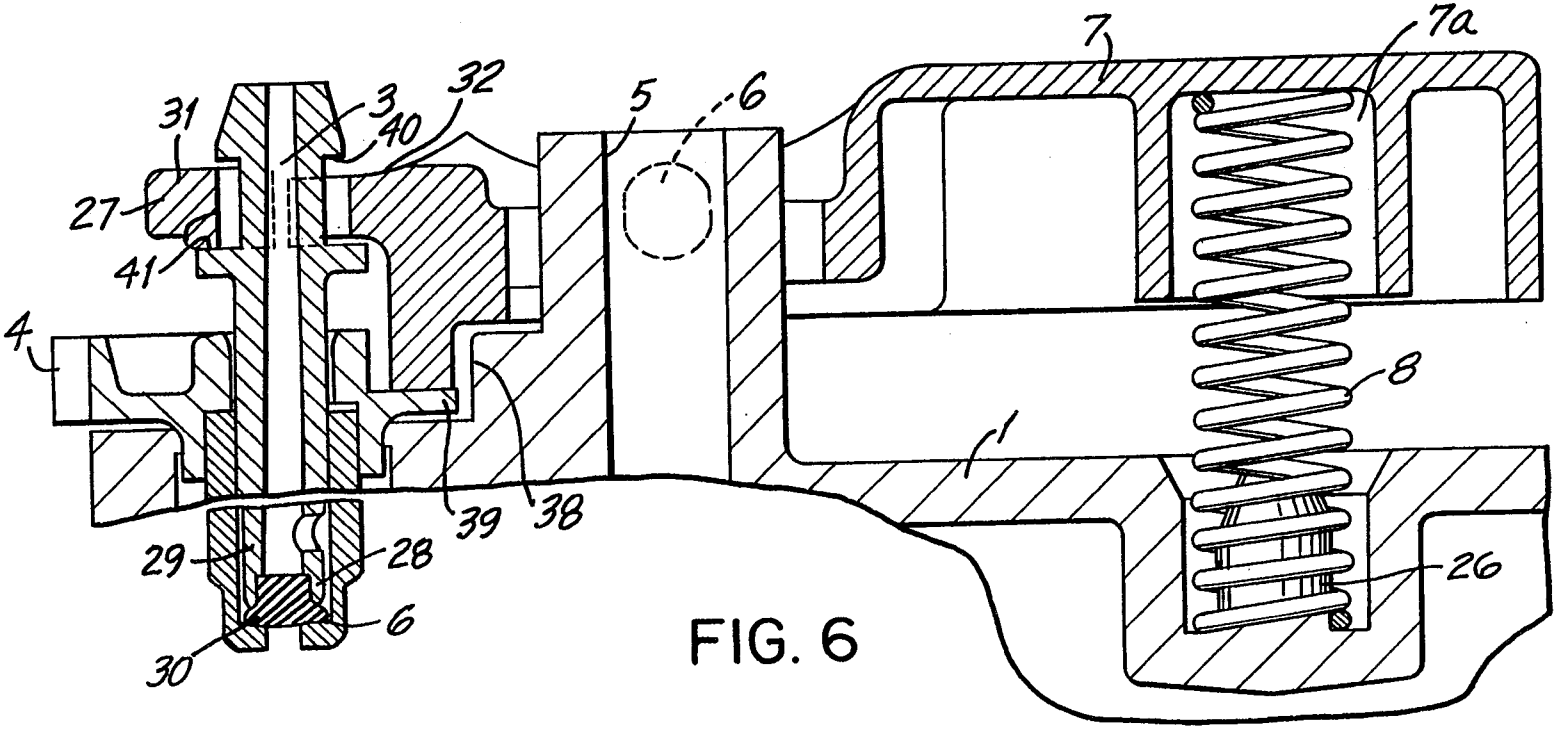
FIG. 6 is a vertical section through the top portion of a gas lighter in accordance with the invention when in its rest position.

In FIG. 6 (from which the safety device has been omitted for reasons of clarity), the lighter body 1 has the following, going from left to right: a passage in which the burner 3 is mounted together with the abutment 4 for adjusting flame height, and a fork 5 for receiving both the striking wheel (not shown) and a pin 6 on which the pushbutton 7 rocks.

The pushbutton 7 engages the compression spring 8 which is imprisoned firstly in a cavity 7*a* formed in the pushbutton 7, and secondly on a guide stud 26 formed in the body 1. As in the prior art, pressure on the top portion of the back end of the pushbutton 7 causes the pushbutton to pivot about its pin 6, thereby raising the front portion or end 27 of the pushbutton.

The front portion 27 raises the burner head 3, and consequently the entire burner as shown in FIG. 6, thereby lifting the seal 28 which is fixed to the bottom portion 29 of the burner from its seat 30 on the chamber port and allowing gas to flow. The compression spring 8 is sufficiently stiff so that a downward external force must be applied to the pushbutton back end (e.g., by the user's finger) in order for the pushbutton front end 27 to unseat the burner 3 from the chamber port.

Figure 7:
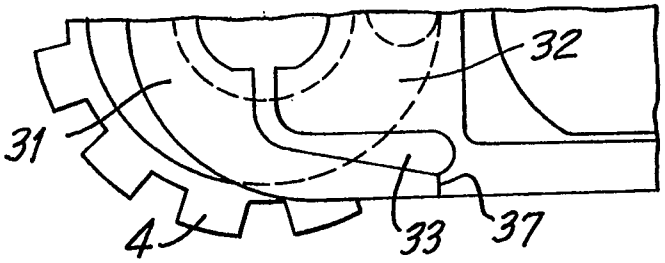
FIG. 7 is a half view in plan of the front portion of the same lighter.

In accordance with a characteristic of the invention, the front portion 28 of the pushbutton 7 is constituted by two zones respectively 31 and 32, which are referred to below as the "flexible" zone 31 and as the "rigid" zone 32. As can be seen in FIG. 7, in the present example, this composite structure comes from a hollow 33 being cut out in the portion 27 (or being formed therein by molding). Thus, the stiffness of the zone 31 depends only on the mechanical strength of the line 37 at the boundary between the two zones 31 and 32.

An abutment 38 projects downwards beneath the zone 32 to limit the stroke of the front portion 27 of the pushbutton 7. In general, this abutment bears against the body 1 of the lighter. In the example shown, it rests against an extension 39 of the adjustment knob 4.

As can be seen in FIG. 6, the flexible portion 31 has a rim 41 whose function is described below.

A lighter provided with a pushbutton of the invention operates as follows:

After acting on the striking wheel, pressure is exerted on the back end of the pushbutton 7, thereby pivoting the pushbutton assembly and raising its front portion 27. The portion 31 of the pushbutton comes into contact with the bottom ring 40 of the burner 3 and raises it, thereby lifting the burner seal off its seat 30 and allowing gas to flow and be ignited. It has been observed that in spite of the resilience of the flexible zone 31, it is nevertheless capable of raising the burner head without difficulty. However, if this is not the case, i.e. if the portion 31 deflects too far, then the rigid zone takes over immediately for applying the required force.

After lighting a cigarette or the like, pressure on the back end of the pushbutton is released. Under the action of the previously compressed spring 8, the pushbutton pivots anticlockwise about its pin 6 and its portion 27 moves back down towards its rest position, thereby closing off the flow of gas by means of the burner seal 28. As it moves back down, the burner is driven by the rim 41 on the portion 31, since the rim projects down lower than the bottom surface of the rigid portion 32. This drive continues until the burner seal is pressed against its seat with adequate pressure. The abutment 38 then makes contact with the part 39 and further motion of the rigid portion 32 is prevented. The only pressure exerted on the burner is that from the rim 41, i.e. pressure due to the resilience of the line 37, and as mentioned above this pressure is limited in value.

In general, it is important that the bottom surface of the flexible zone 31 is located at a lower level than the bottom surface of the rigid zone 32. If the flexibility of the zone 31 is sufficient, the abutment 38 for making the end of the stroke of the rigid zone 32 may be omitted. In any event, it is deformation of the flexible zone which transmits the desired pressure to the seal. Naturally, the flexible zone could be a circular central zone projecting beneath the peripheral zone. If the pushbutton of the lighter is provided with a safety catch as mentioned above, it is necessary to leave a certain amount of clearance between the parts in order to allow them to move without friction. This means that the application of pressure on the pushbutton could allow gas to escape even with the safety catch in the safety position. However, the flexibility of the portion 31 deforms and prevents the seal 30 from being lifted off its seat.

The above description is Given in the context of a conventional flint lighter. However analogous means could be implemented for piezoelectric lighting, in which case the pushbutton would be a sliding component instead of a rocking component.

What is claimed is:

1. A child resistant safety lighter comprising:

a main body having a chamber of combustible fluid, said chamber having an opening for release of said combustible fluid;

a burner member having a head portion at one end and a sealing means at the other end for sealing said combustible fluid in said chamber, said burner member being moveable into and out of sealing engagement with said chamber;

a pushbutton member having a pushbutton back end and a pushbutton front end, said pushbutton member being hinged for rotation to said main body intermediate said pushbutton front and back ends, said pushbutton front end being operatively connected to said burner and said pushbutton back end being adapted to rotate toward said main body, said pushbutton back end including a depending backwall having an upwardly extending notch formed therein;

a compression spring positioned to bias said pushbutton back end away from said main body, whereby said pushbutton front end is urged toward said main body to lower said burner into sealing engagement with said chamber;

locking means for preventing rotation of said pushbutton member to unseal said combustible fluid chamber, said locking means comprising a spring-loaded movable safety tab positioned between said main body and said depending backwall, said safety tab projecting outwardly of said main body between said main body and said depending backwall wherein, when said pushbutton is rotated to lower said burner into sealing engagement with said chamber, said pushbutton back end rotates away from said main body sufficiently so that a slot is defined by a clearance between sections of said main body and depending backwall adjacent to said safety tab, said slot opening into said notch and extending transversely with respect to the rotational plane of said pushbutton member, said safety tab defining an unlocked non-interfering position when located in the part of said slot opening into said notch thereby enabling rotation of said pushbutton back end toward said main body so that said notch becomes coextensive with said safety tab enabling said burner member to move out of sealing engagement with said chamber, said safety tab further defining a locked interfering position when located in said slot away from said notch wherein engagement between said safety tab and depending backwall obstructs rotation of said pushbutton back end toward said main body so that said burner remains in sealing engagement with said chamber, said safety tab being movable within said slot between said locked interfering position and said unlocked non-interfering position by opposing collinear forces which are parallel to the periphery of said main body adjacent to said slot and which lie in a plane perpendicular to said rotational plane, said spring of said spring-loaded safety tab resisting movement of said safety tab away from said locked interfering position to said unlocked non-interfering position;

said locking means further comprising tab retention means for holding said safety tab in its unlocked non-interfering position against said resistance of said spring of said spring-loaded safety tab and tab release means for automatically disengaging said tab retention means when said pushbutton back end is pivoted toward said upper body end sufficiently to move said burner member out of sealing engagement with said chamber, said safety tab being forced by said spring of said spring-loaded safety tab to automatically return said safety tab to said locked interfering position upon rotation of said pushbutton back end away from said main body sufficient to form said slot.

2. A child resistant safety lighter according to claim 1, wherein:

said spring-loaded movable safety tab comprises a spiral spring connected to said safety tab, said spiral spring having a fixed end and a free end, said spiral spring being in the relaxed state when said safety tab is in its locked interfering position and in a tensed state when said safety tab is in its unlocked non-interfering position within said notch.

3. A child resistant safety lighter according to claim 2, wherein:

said tab retention means comprises a notch formed in the free end of said spiral spring and a mating hook formed in said main body.

4. A child resistant safety lighter according to claim 3 wherein:

said tab release means comprises an upwardly extending inclined cam surface on said safety tab and a mating surface depending downwardly from said pushbutton back end adapted to engage said cam surface and force said spiral spring notch out of engagement with said body member hook as said pushbutton back end is depressed.

5. A child resistant safety lighter according to claims 1, 2, 3 or 4 wherein said compression spring exerts an upward force on said pushbutton back end greater than about 15 newtons.

6. A child resistant safety lighter according to claim 1 wherein said clearance is defined by a recess in said main body.

7. A safety lighter comprising:

a one-piece lighter body having an upper body end and a body side depending from said upper body end, said body having a chamber containing volatile fluid and a chamber port formed on said upper body end enabling combustible vapors to escape from said chamber;

a burner which closes said chamber port when seated thereon, said burner being supplied with combustible vapors from said chamber port when lifted up off said chamber port;

a pushbutton member having a pushbutton back end and a pushbutton front end, said pushbutton member being hinged between said pushbutton back and front ends directly to said upper body end adjacent to said chamber port, said hinged connection enabling said pushbutton member to pivot about an axis wherein translation of said pushbutton back end toward and away from said upper body end produces concomitant travel of said pushbutton front end in the opposite direction, said pushbutton front end interlocking with said burner so that displacement of said pushbutton back end toward said upper body end causes said burner to lift up off said chamber port and displacement of said pushbutton back end away from said upper body end causes said burner to seat on said chamber port;

a compression spring mounted directly on said upper body end and pushbutton back end wherein displacement of said pushbutton back end toward said upper body end is resisted by said compression spring;

a catch disposed between said upper body end and pushbutton back end., said catch projecting outwardly of said upper body end so that, when said catch is in a locked interfering position between said upper body end and pushbutton back end, said catch obstructs downward displacement of said pushbutton back end with respect to said upper body end and the associated upward displacement of said front end so that said burner remains seated on said chamber port, said pushbutton back end and upper body end adjacent to said catch being shaped so that, when said catch is located in an unlocked non-interfering position between said upper body end and said pushbutton back end, said catch allows sufficient downward movement of said pushbutton back end with respect to said upper body end and associated upward movement of said pushbutton front end to unseat said burner from said chamber port and allow combustible vapors to flow from said chamber into said burner, said pushbutton back end and said upper body end being shaped to define a clearance between sections of said upper body end and pushbutton back end adjacent to said catch when said pushbutton back end is sufficiently raised to cause said burner to seat on said chamber port, said catch being movable within said clearance between said locked interfering position and said unlocked non-interfering position by opposing collinear forces which are parallel to the periphery of said main body adjacent to said clearance and which lie in a plane which is perpendicular to said rotational plane;

a locking spring mounted directly on said catch and upper body end, wherein said locking spring resists movement of said catch through said clearance toward said unlocked non-interfering position; and a retainer fixed to said catch, said retainer interlocking with said upper body end when said catch is in said unlocked non-interfering position to retain said catch in said unlocked non-interfering position against said resistance of said locking spring, wherein, when said pushbutton back end is depressed sufficiently to cause said pushbutton front end to unseat said burner from said chamber port, said retainer disengages from said upper body end resulting in said locking spring forcing said catch to said locked interfering position when said pushbutton back end translates away from said upper body end sufficiently to enable formation of said clearance.

8. A safety lighter as set forth in claim 7, wherein said pushbutton back end includes a depending rear sidewall which engages said catch when said catch is in said locked interfering position so that said catch sufficiently obstructs said downward displacement of said back end with respect to said upper body end and associated upward displacement of said front end to prevent said front end from unseating said burner from said chamber port, said rear sidewall having a notch which, when said catch is in said unlocked non-interfering position and said back end is downwardly displaced with respect to said upper body end, becomes coextensive with said catch to enable sufficient downward displacement of said back end and concomitant upward displacement of said front end to unseat said burner from said chamber port.

9. A safety lighter as set forth in claim 8, wherein said clearance is defined by a slot formed in said upper body end adjacent to said catch.

10. A safety lighter as set forth in claim 7, wherein said locking spring comprises a spiral spring having a fixed end and a free end, said spiral spring being relaxed when said catch is in said locked interfering position and being tensed when said catch is in said unlocked non-interfering position.

11. A safety lighter as set forth in claim 10, wherein said retainer comprises a retaining notch formed in said free end, said retainer further comprising a mating hook formed on said upper body end which, when said catch is in said unlocked non-interfering position, grasps said retaining notch to retain said catch in said unlocked non-interfering position.

12. A safety lighter according to claim 11, wherein said retainer further comprises an inclined cam extending upwardly from said catch, said retainer further comprising a mating surface depending downwardly from said pushbutton back end, said mating surface engaging said cam when said back end is sufficiently close to said upper body end to cause said front end to unseat said burner from said chamber port, said mating surface and cam being shaped so that their said engagement causes said retaining notch to separate from said mating hook, said spiral spring forcing said catch along said clearance to said locked interfering position when said back end is spaced sufficiently apart from said upper body end to enable formation of said clearance.

* * * * *